United States Patent [19]

Pringle

[11] Patent Number: 4,462,239

[45] Date of Patent: Jul. 31, 1984

[54] METHOD FOR MANUFACTURING A BEARING SUPPORT COLLAR

[76] Inventor: William L. Pringle, 999 Lake Shore Rd., Grosse Pointe Shores, Mich. 48236

[21] Appl. No.: 431,224

[22] Filed: Sep. 30, 1982

[51] Int. Cl.[3] ..... B21D 22/02

[52] U.S. Cl. ..... 72/359; 72/370

[58] Field of Search ..... 228/173 F, 173 R, 173 B, 228/135, 136, 160, 162, 165; 301/124 R; 72/354, 358, 359, 370

[56] References Cited

U.S. PATENT DOCUMENTS

| | | | |
|---|---|---|---|
| 2,810,478 | 10/1957 | Sejournet et al. | 72/358 |
| 3,453,720 | 7/1969 | Gerard | 301/124 R |
| 3,701,564 | 10/1972 | Puzik | 301/131 |
| 4,298,155 | 11/1981 | Palovcik | 228/114 |

FOREIGN PATENT DOCUMENTS

| | | | |
|---|---|---|---|
| 559902 | 9/1932 | Fed. Rep. of Germany | 72/359 |
| 426739 | 5/1974 | U.S.S.R. | 72/359 |

*Primary Examiner*—Nicholas P. Godici
*Assistant Examiner*—Thomas S. Mieczkowski
*Attorney, Agent, or Firm*—Reising, Ethington, Barnard, Perry & Milton

[57] ABSTRACT

A method is provided of making a collar (10') having an annular flat outer surface (118) and an inner surface having an inwardly tapering first portion (120) and peripheral outwardly tapering notch portion (122). The method includes the steps of providing a die assembly including a die cavity having an annular seating surface (130) with an opening (132) therethrough and an annular side wall (134) and a reciprocating forming die (136). The die (136) includes a shoulder portion (138) closely fitting against the side wall (134) of the cavity (128) and a cylindrical portion (140) and a frustoconical portion (142) therebetween. The forming die (136) enters the die cavity (128) whereby the cylindrical portion (140) enters the opening (132) of the seating surface (130) so that the cylindrical portion is spaced therefrom. A preformed cylindrical collar (10) is disposed in the die cavity and compressed between the shoulder (138) and seating surface (130) to cold form the first portion (120) of the preformed collar (10) against the frustoconical pg,2 surface (142) and to cold form the notch portion (122) within the space between the cylindrical portion (140) and the seating surface (130). The collar (10') is mounted on the frustoconical portion (150) of an axle (148) so as to press-fit the inwardly tapering portion (120) of the collar (10) against the frustoconical portion of the axle (148) and securing the collar (10) to the axle (148). The peripheral face (152) of the collar (10') is machined away a predetermined amount into the notch portion (122) as the notch portion (122) provides clearance between the machining tool (156) and the wheel axle (148).

2 Claims, 12 Drawing Figures

METHOD FOR MANUFACTURING A BEARING SUPPORT COLLAR

TECHNICAL FIELD

This invention relates to a method of making a bearing support collar and mounting the bearing support collar upon a rear axle collar.

BACKGROUND ART

Generally, wheel bearing assemblies are mounted upon wheel axles during the manufacturing of wheel assemblies for various types of vehicles. An integral, radially extending wheel bearing stop is frequently provided on the rear axle. The wheel bearing stop generally comprises a collar fixedly secured to the axle as by welding. An example of such an assembly is disclosed in U.S. Pat. No. 4,298,155 to Palovcik. However, there continues to be a need for more efficient methods of forming the collars prior to mounting the collars on the wheel axle as well as methods for mounting the collars on the wheel axle and finishing the collar without damaging the wheel axle. More particularly, a problem arises when a wheel bearing support collar is mounted on a wheel axle and then machined to predetermined tolerances. The instant invention provides a method and means for forming a collar and further provides a method for mounting the collar on a wheel axle and finishing the collar to predetermined tolerances without damaging the wheel axle.

STATEMENT OF INVENTION

According to the present invention, there is provided a method of making a collar having an annular and flat outer surface and an inner surface having an inwardly tapering first portion with a peripherally outwardly tapering notch portion wherein the method includes the steps of providing a die assembly including a die cavity having an annular seating surface with an opening therethrough and an annular side wall and a reciprocating forming die including a shoulder portion closely fitting against the side wall of the cavity and a cylindrical portion and a frustoconical portion therebetween. The forming die enters the die cavity whereby the cylindrical portion enters the opening of the seating surface so that the cylindrical portion is spaced therefrom. A preformed cylindrical collar is disposed in the die cavity and the preformed collar is compressed between the shoulder and the seating surface to cold form the first portion of the preformed collar against the frustoconical surface of the forming die and to cold form the notch portion within the space between the frustoconical portion and the seating surface. The instant invention further provides a method of making a wheel axle having a frustonical portion and the collar mounted thereon having a predetermined width. The method includes the steps of mounting the collar on the frustoconical portion of the axle so as to press-fit the inwardly tapering portion of the collar against the frustoconical portion of the axle, securing the collar to the axle, and machining the peripheral face of the collar a predetermined amount into the notch portion which provides clearance between the machining tool and the wheel axle.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
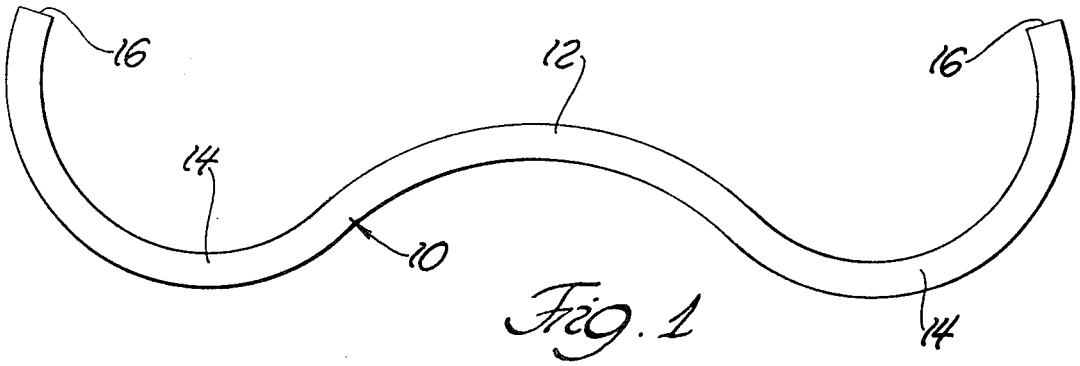
FIG. 1 is a plan view of a prebent bar stock member which is a precursor to the preformed collar of the instant invention.
Figure 2:
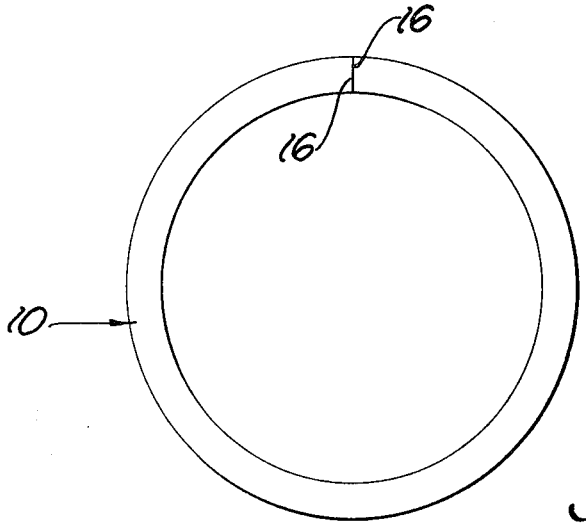
FIG. 2 is a plan view of a preformed collar.
Figure 7:
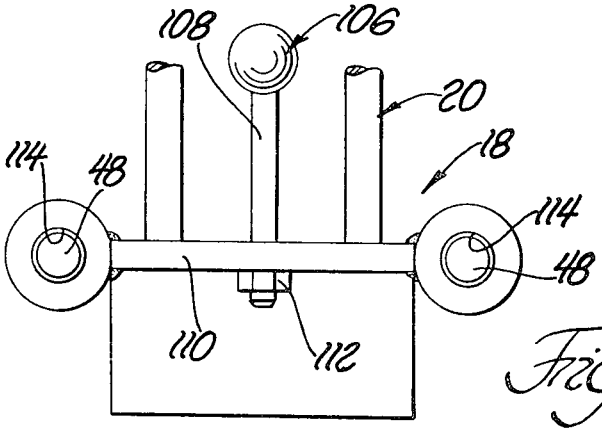
FIG. 7 is a side elevational view taken substantially along lines 7—7 of FIG. 3.
Figure 8:
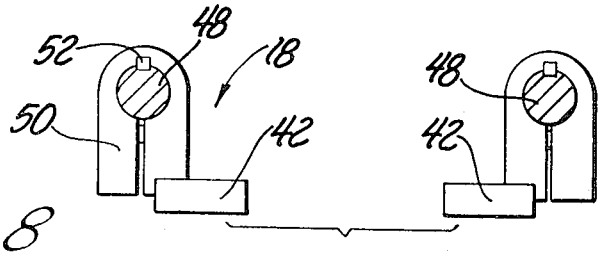
FIG. 8 is a cross-sectional view taken substantially along lines 8—8 of FIG. 3.

A preformed collar is generally indicated at 10 in the FIGURES. As shown in FIGS. 1 and 2, the preformed collar 10 is made by bending a bar stock member having a predetermined length in a first die so that the bar has a central curved portion 12 and arcuately bent distal end portions 14. The distal end portions 14 are bent such that the ends 16 of the bar stock extend on the radius of the final predetermined circular shape of the collar 10. The prebent bar stock is bent around a mandrel to abut the ends 16, as shown in FIG. 2. Since the arc of each bent end 16 is greater than 90°, the prebent ends 16 are moved together as the central portion 12 of the bar stock is bent about the mandrel. Since the ends 16 are prebent on the desired radius of the final preformed collar, the ends 16 abut and remain on the desired radius after the center portion 12 of the bar is bent. Once the bar is bent around the mandrel, the ends 16 of the bar are welded together and then annealed.

Figure 3:
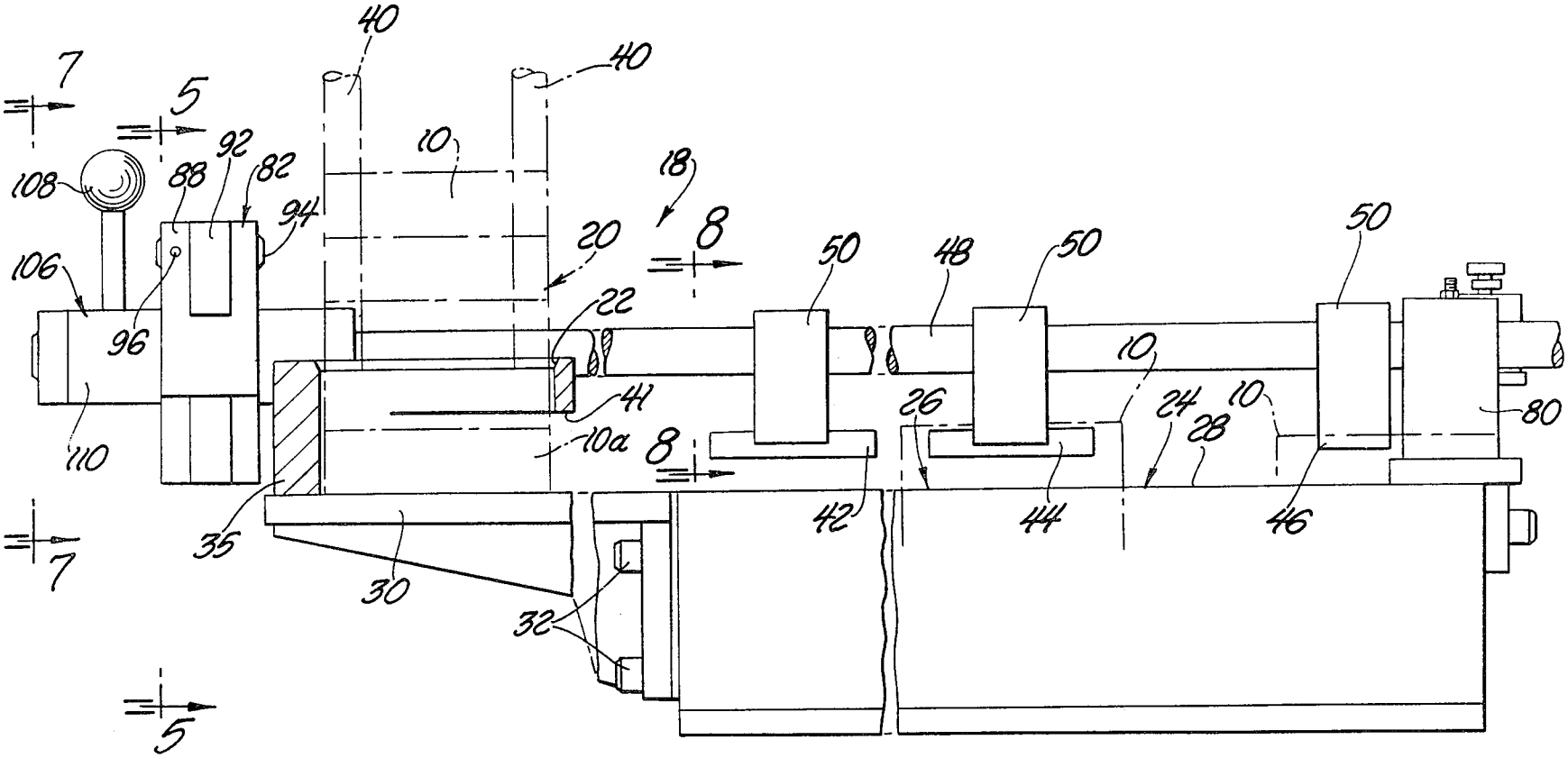
FIG. 3 is a fragmentary longitudinal elevational view of an assembly for advancing preformed collars constructed in accordance with the instant invention.

The preformed collars 10 are disposed in a storage station of an assembly for advancing the preformed collars from the storage station to a die station, the assembly being generally shown at 18 in FIGS. 3–8. The assembly 18 includes a storage station, generally indicated at 20, having a compartment 22 for storing the preformed collars 10 and support means, generally indicated at 24 for supporting the preformed collars 10 between the storage station 20 and a die station, generally indicated at 26. More specifically, the support means 24 includes a substantially flat platform portion 28 and a shelf 30 secured thereto by bolts 32. Dowels 34 extend from the platform 28 and mate with openings in the shelf 30 for alignment of the shelf 30 in relation to the platform 28. The shelf 30 is aligned with the platform 28 so as to provide a continuous substantially flat upper surface upon which the preformed collars 10 are advanced from the storage station 20 to the die station 26. The storage station 20 includes an escapement 35 being secured to the shelf 30 by screws 36. The shelf 30 includes dowels 38 extending upwardly therefrom mating with openings in the escapement 35 for alignment of the escapement 35 upon the shelf 30. A second plurality of dowels 40 extend upwardly from the shelf 30 about the storage station 20 for supporting a stack of preformed collars 20. The escapement 35 provides guide means for guiding the plurality of preformed collars 10 stacked above the storage station 20 to the storage station 20 as the lowermost of the preformed collars 10 is advanced along the support means 24 to the die station 26. The escapement 35 defines the compartment 22 wherein the preformed collars 10 are stored. As shown in FIG. 3, the lowermost preformed collar 10*a* is advanced from the storage station 20 through an opening 41 in the escapement 35 towards the die station 26.

The assembly 18 includes advancing means mounted on the support means 24 for reciprocating movement for advancing the preformed collars 10 along the support means 24. In other words, the advancing means transfers the stacked preformed collars 10 one by one from the storage station 20 to the die station 26, the collars 10 being deformed by a forming die at the die station 26.

The advancing means includes two pair of intermediate arms 42 and 44 and one pair of terminal arms 46. The advancing means further includes first actuator means generally indicated at 58 for moving the arms 42, 44 and 46 between an engaging position wherein the arms 42, 44 and 46 engage the preformed collars 10 and a nonengaging position wherein the arms 42, 44, 46 release the preformed collars 10. The assembly 18 also includes second actuator means generally shown at 106 for moving the arms 42, 44, 46 relative to the support means 24 between a neutral position and an advanced position to move the preformed collars 10 from the storage station 20 towards the die station 24.

The advancing means further includes a pair of rods 48 supported above the support means 24, each of the arms 42, 44, 46 being fixedly mounted on one of the rods 48. As shown in detail in FIG. 8, a bracket 50 is fixedly secured to the rod 48 and prevented from rotation by key 52. Arms 42, 44, 46 are secured to and extend from the bracket 50 whereby rotation of the rods 48 rotate the arms 42 about the rods 48.

The intermediate arms 42 and 44 include a substantially C-shaped peripheral surface 54 for engaging the preformed collars 10 to advance the preformed collars 10 along the support means 24 towards the die station 26. The terminal arms 46 have an inwardly tapering peripheral surface 56 for advancing the preformed collars 10 away from the die station 26 after the pressing operation of the die has been completed.

The first actuator means 58 actuates rotation of the rods 48 to pivot the arms 42, 44, 46 between the engaging and nonengaging positions. The first actuator means 58 includes a control member 60 for controlling the operation of a hydraulic cylinder 62. The hydraulic cylinder 62 is an air cylinder having a piston 64 extending therefrom. The cylinder is mounted on a bracket 66 which is secured to one of the rods 48. A key 68 prevents relative rotation between the bracket 66 and rod 48. A Miller rod eye one inch lever 70 interconnects the rod 64 to a rod end lever 72. The lever 72 is mounted on the other of the rods 48, key member 74 preventing relative rotation between the lever 72 and rod 48. The cylinder 62 is operatively connected to a limit switch 76 by a limit switch mount 78. In operation, actuation of the hydraulic cylinder 62 by the control member 60 extends the piston rod 64 from the hydraulic cylinder 62 so as to pivot the bracket 66 and lever 72 about the axes defined by the respective rod members 48 thereby rotating the rods 48. Extension of the piston rod 64 rotates the rods 48 so as to move the arms 42, 44, 46 to the nonengaging position wherein the arms 42, 44, 46 extend substantially upwardly from the support means 24. Retraction of the piston rod 64 into the cylinder 62 rotates the rods 48 so as to move the arms 42, 44, 46 to the engaging position wherein the arms 42, 44, 46 are substantially parallel to the support means 44 so as to engage a preformed collar 10 which is disposed upon the upper surface 28 of the support means 24.

Figure 4:
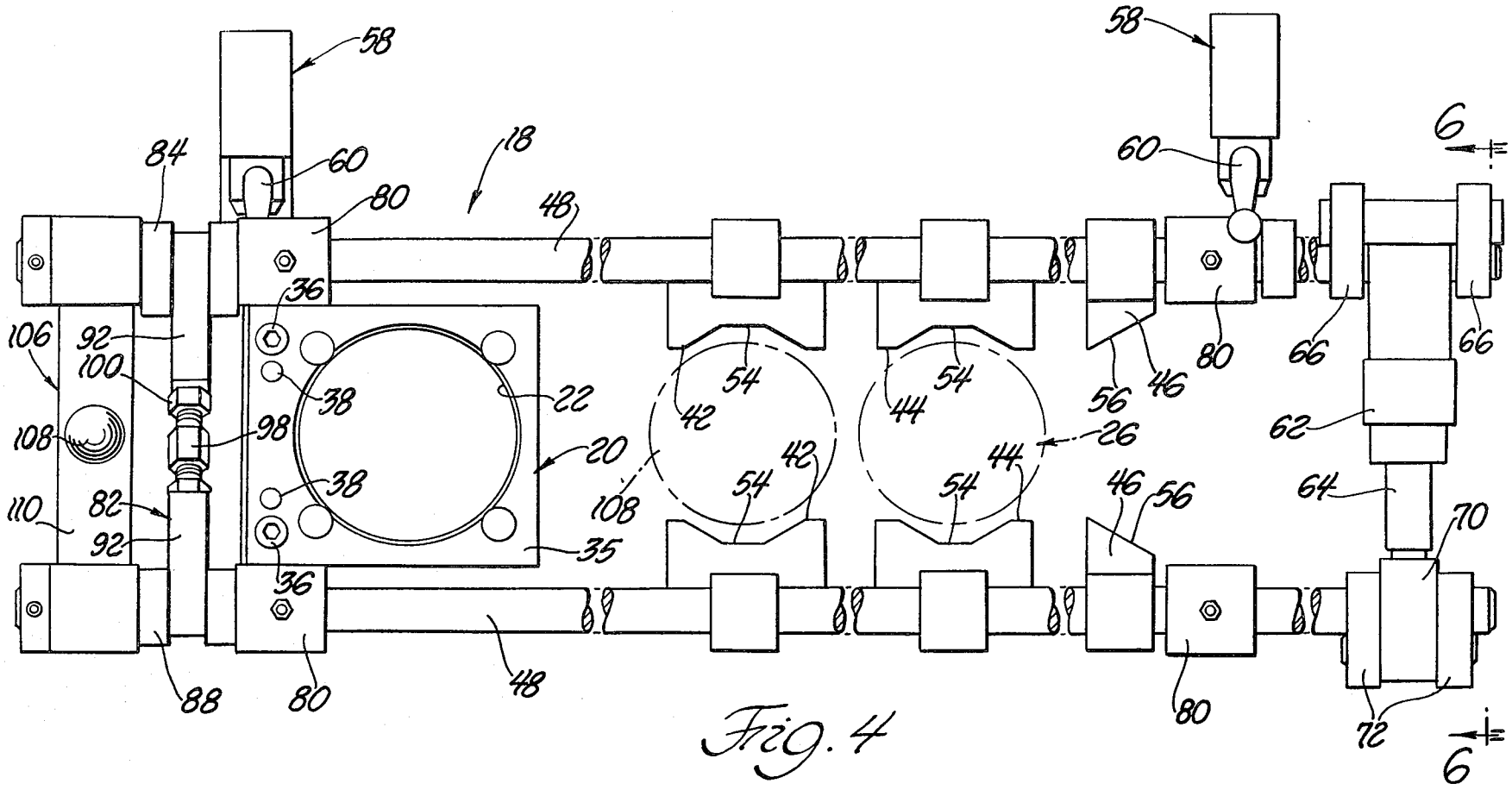
FIG. 4 is a fragmentary top plan view of the assembly shown in FIG. 3.
Figure 5:
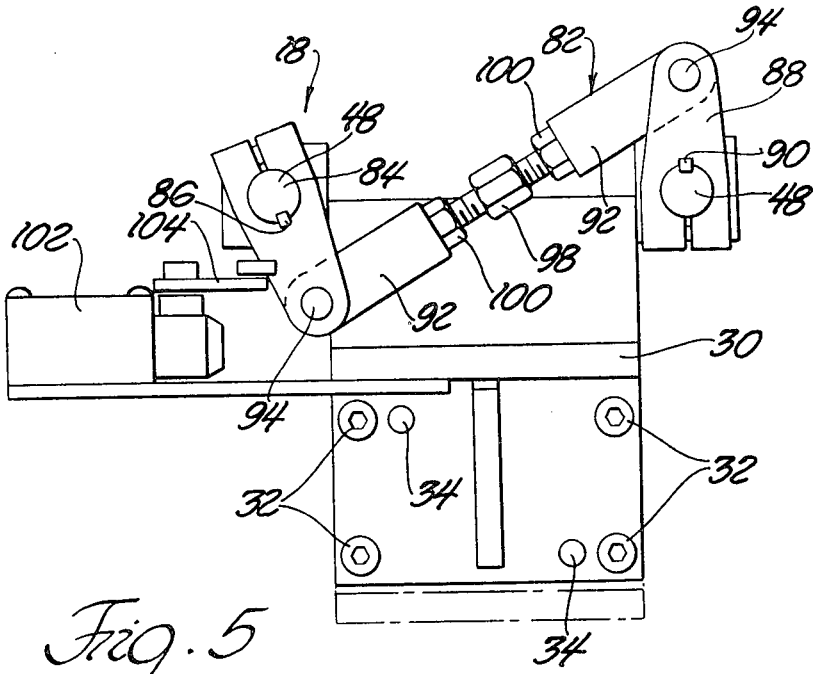
FIG. 5 is a side elevational view in cross section taken substantially along lines 5—5 of FIG. 3.
Figure 6:
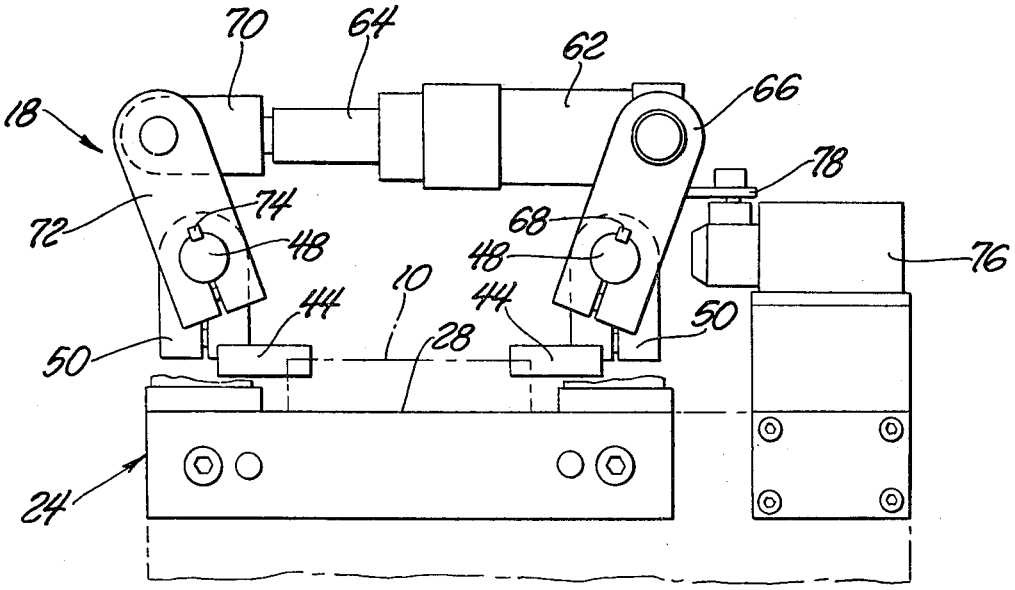
FIG. 6 is a side elevational view taken substantially along lines 6—6 of FIG. 4.

As shown in FIGS. 3 and 4, the rods 48 are further supported for rotation and longitudinal movement in Oilite bearings 80.

The assembly 18 includes stabilizing means generally indicated at 82 interconnecting the ends of the rod 48 opposite those ends connected to the hydraulic cylinder 62 and piston rod 64 for rotating one of the rods 48 an equal amount as the other of the rods 48 when the hydraulic cylinder 62 is actuated. In other words, actuation of the rods 48 solely by the hydraulic cylinder 62 and piston rod 64 would not ensure that both of the rods 48 would rotate an equal amount. The stabilizing means rotates one of the rods 48 an amount equal to the actuated rotation of the other of the rods 48 and vice versa.

The stabilizing means 82 includes a first stabilizing lever 84 connected to an end portion of one of the rods 48 and extending substantially downwardly therefrom. A key 86 prevents relative rotation between the rod 48 and lever 84. A second stabilizing lever 88 is connected to the end portion of the other of the rods 48 and a second key 90 prevents relative rotation therebetween. The second lever 88 extends substantially upwardly from the rod member 48. The stabilizing means 82 further includes connecting means for connecting the first and second stabilizing levers 84 and 88 whereby rotation of one of the rods 48 pivots the connected one of the stabilizing levers 84, 88 which pivots the other of the stabilizing levers 84, 88 by the connecting means thereby rotating the other of the rods 48 an equal amount. The connecting means includes a turn buckle 92 pivotally connected to each of the levers 84, 88 by a pin 94, the pin 94 being secured to each of the levers 84, 86 by a set screw 96, as shown in FIG. 3. A turn buckle rod 98 is fixedly secured by hexagonal nuts 100 to each of the turn buckle links 92 so as to operatively interconnect the stabilizing levers 84 and 88. Thusly, any rotation of either rod 48 pivots the connected lever 84, 88 which, in turn, actuates movement of the turn buckle end links 92 and turn buckle 98 so as to pivot the other of the levers 84, 88 an equal amount and rotate the other of the rods 48 an amount equal to that rotation of the first of the rods 48. A limit switch 102 is operatively connected by a limit switch link 104 to the lever 84 so as to limit the motion of the lever 84 a predetermined amount. Additionally, the turn buckle 98 allows for adjustment of the positioning of the arms 42, 44, 46 by adjustment of the connecting hexagonal bolts 100. In other words, the bolts 100 can be adjusted so as to separate the turn buckle links 92 thereby lengthening the connecting means. By lengthening the connecting means the levers 84 and 88 rotate the rods 48 so as to adjust the orientation of the arms 42, 44, 46.

The second actuator means 106 moves the rods 48 axially to reciprocate the arms 42, 44, 46 between the neutral and advanced positions. More specifically and as shown in detail in FIG. 7, the second actuator means 106 includes a control arm 108 fixedly secured to a retainer member 110 by a hexagonal nut 112. Rod members 48 are secured in openings 114 at each end portion of the retainer 110. The control member 108 is manually operated to move the rods 48 longitudinally along the support means 24 within the bearings 80.

The support means 24 may include an intermediate station schematically shown at 108 when the length of the support means 24 in such that there is a large distance between the storage station 20 and die station 26. With such an embodiment, a preformed collar 10 is advanced from the intermediate station 108 to the die station 26 by arms 44 as a second preformed collar is advanced from the storage station 20 to the intermediate station 108. Concurrently, a collar which has been acted upon at the die station 26 is advanced from the die station 26 by the arms 26.

In operation, a plurality of preformed collars 10 are stacked above the storage station 20 and escapement 35 and supported within the dowels 40, the dowels 40 being equally spaced so that the dowels 40 engage the outer circumference of the collars 10. The arms 42, 44, 46 are actuated to move by the second actuator means 106 to the neutral position wherein the arms 42 are disposed about the foremost collar 10*a* at the storage station 20. The first actuator means 58 is actuated by the control member 60 to move the arms 42, 44, 46 to the engaging position wherein the arms 42 engage the lowermost preformed collar 10'. The second actuator means 106 is manually operated to advance the rod members 48 longitudinally to move the arms 42, 44, 46 to the advanced position so as to advance the preformed collar 10' to the intermediate station 108. The arms 42, 44, 46 are then actuated to the nonengaging position and are moved longitudinally by the second actuator means 106 to the neutral position wherein the arms 44 are disposed about the collar 10. The arms are then actuated to the engaging position wherein the arms 44 engage the collar. The arms 44 are then actuated to the advanced position so that the arms 44 advance the collar 10 to the die station 26. The arms 42, 44, 46 are then actuated to the nonengaging position and the die acts upon the collar 10, as will be described below. The arms 42, 44, 46 are then actuated to the neutral position so that the arms 46 are disposed about the collar 10. The cycle is completed by the arms 46 being actuated to the advanced position so as to remove the collar 10' from the die station 26. Of course, as the first collar is moved from the intermediate station 108 to the die station 26, a second collar 10 is moved from the storage station 20 to the intermediate station 108. In this way, a series of preformed collars are continuously advanced from the storage station 20 to the intermediate station 108 and then to the die station 26 and finally are removed from the die station 26.

Figure 9:
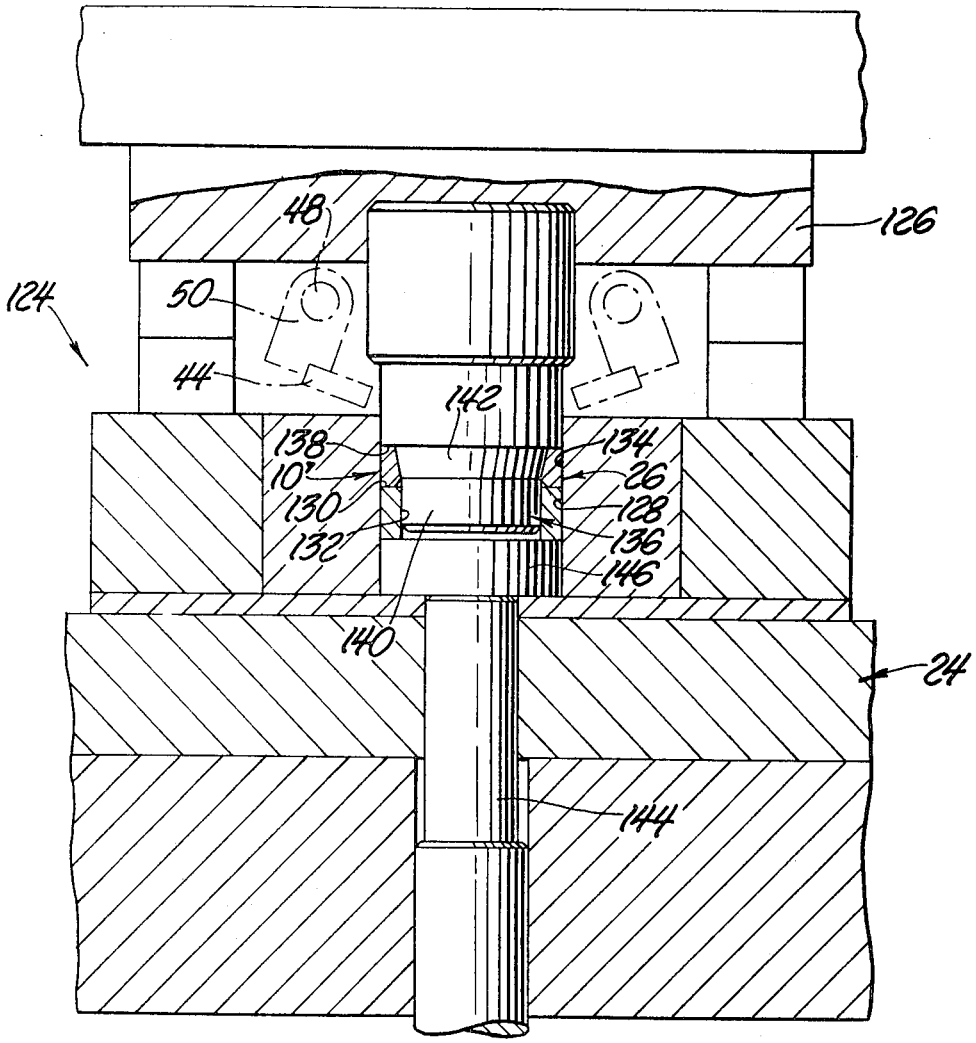
FIG. 9 is an elevational view in cross-section of a forming die constructed in accordance with the instant invention.
Figure 10:
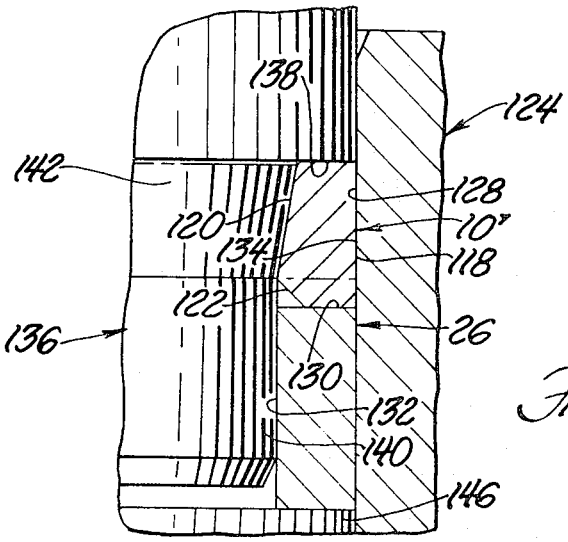
FIG. 10 is an enlarged fragmentary view of the forming die.

The instant invention further provides a method of making a collar 10', as shown in FIGS. 9 and 10. The collar 10' has an annular and flat outer surface 118 and an inner surface having an inwardly tapering first portion 120 at a peripheral outwardly tapering notch portion 122, as shown in detail in FIG. 10.

A die assembly, generally shown at 124 in FIGS. 9 and 10, is provided at the die station 26. The die assembly 124 includes a support structure 126 mounted upon the support means 24. The assembly 124 further includes a die cavity 128 having an annular seating surface 130, the seating surface 130 having an opening 132 therethrough. The die cavity 128 further includes an annular side wall 134. A reciprocating forming die generally indicated at 136 is supported for reciprocating movement into and out of the die cavity 128. The forming die 136 includes a shoulder portion 138 closely fitting against the side wall 134 of the cavity 128 when the reciprocating forming die 136 is disposed within the cavity 128. The forming die further includes a cylindrical portion 140 and a frustoconical portion 142, the frustoconical 142 being disposed between the cylindrical portion 140 and the shoulder 138. The forming die 136 reciprocates to enter the die cavity 128 whereby the cylindrical portion 140 enters the opening 132 of the seating surface 130. The die assembly 124 further includes a knock out punch 144 and a knock out member 146, the knock out punch 144 being able to reciprocate between a neutral position and an extended position wherein the knock out punch 144 raises the knock out member 146 to raise the collar 10' from the die cavity 128.

The method provided by the instant invention includes the steps of providing the aforementioned die assembly 124 and disposing a preformed cylindrical collar 10 in the die cavity 128 of the die assembly 124. The preformed collar 10 is compressed between the shoulder 138 of the forming die 136 and the seating surface 130 to cold form the first portion 120 of the preformed collar 10 against the frustoconical surface 142 of the forming die 136 and to cold form the notch portion 122 of the collar 10 within the space between the cylindrical portion 140 and the seating surface 130. In other words, as the shoulder 138 compresses the collar 10 against the seating surface 130, there is cold flow of the collar material inwardly against the frustoconical surface 142 of the forming die 136 and downwardly at an angle towards the cylindrical portion 140 of the forming die and the seating surface 130. The forming die 136 is inserted into the die cavity 128 a predetermined amount so as to form the first portion 120 of the collar 10' against the frustoconical surface 142 of the forming die 136 and to cause sufficient cold flow of the material of the preformed collar to form the notch portion 122. The shape of the notch portion 122 is accordingly dependent upon the extent to which the forming die 136 is inserted into the die cavity 128. In other words, the further that the forming die 136 is inserted into the die cavity 128, the more cold flow there will be so as to decrease the size of the notch portion 122.

Figure 11:
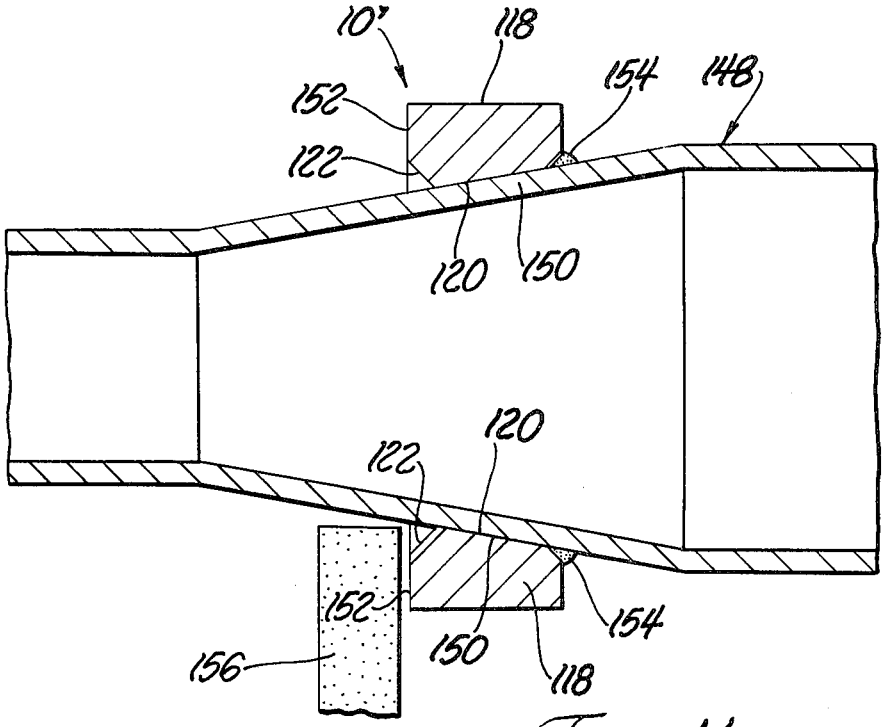
FIG. 11 is a longitudinal view in cross section of a collar constructed in accordance with the instant invention mounted upon an wheel axle prior to machining and FIG. 12 is a longitudinal view in cross section of a finished collar mounted on a wheel axle.
Figure 12:
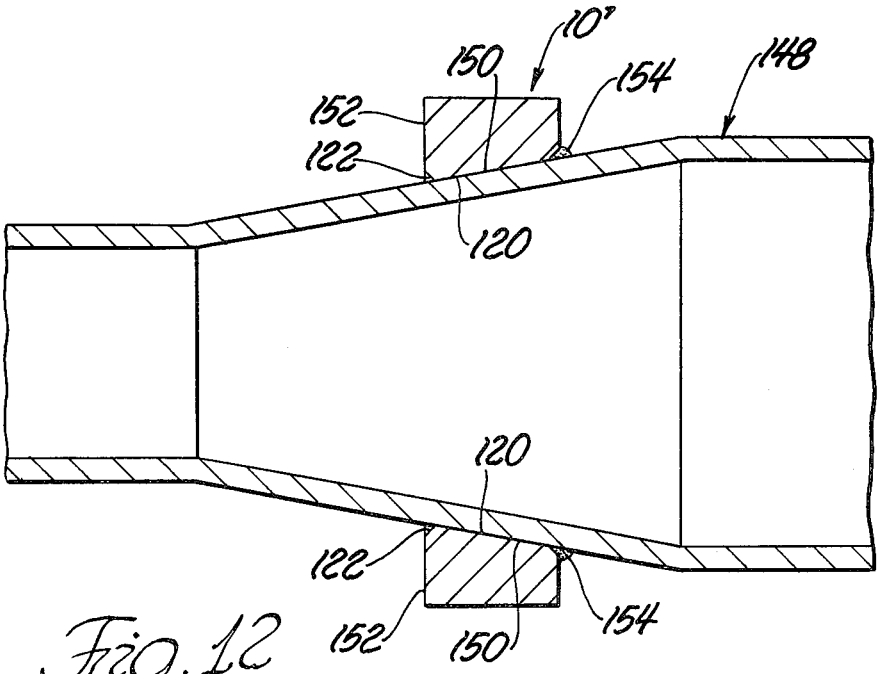

The instant invention further provides a method of making a wheel axle, generally indicated at 148 in FIGS. 11 and 12, having a frustoconical portion 150 and the collar 10' mounted thereon having a predetermined width. The method includes the steps of mounting the collar 10' having an inner surface with the inwardly tapering portion 120 and the peripheral outwardly tapering portion or notch 122 adjacent to the peripheral face 152 thereof on the frustoconical portion 150 of the axle 148 so as to pressfit the inwardly tapering portion 120 of the collar 10' against the frustoconical portion 150 of the axle 148. The collar 10' is then secured to the axle 148 by a weld 154. A machining tool such as a grinder, schematically shown at 156, grinds the peripheral face 152 of the collar 10' a predetermined amount into the notch portion 122, the notch portion 122 providing clearance between the grinder 156 and the wheel axle 148 thereby sparing the wheel axle 148 from contact with the grinder 156. The assembly may be heat-treated to an induction hardness of 40 to 45 on the Rockwell C scale prior to the grinding step. Thusly, in accordance with the instant invention, a method is provided for finishing the bearing collar 10 to a predetermined tolerance by a grinding operation whereby the axle 48 is spared from abrasion by the grinder 156; that is, the notch 122 provides a clearance between the peripheral face 152 which is acted upon by the grinder 156 and the surface of the axle 148.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A method of making a collar (10') having an annular and flat outer surface (118) and an inner surface having an inwardly tapering first portion (120) and a peripheral outwardly tapering notch portion (122), said method comprising the steps of: providing a die assembly (124) including a die cavity (128) having an annular seating surface (130) with an opening (132) therethrough and an annular side wall (134) and a reciprocating forming die (136) including a shoulder portion (138) closely fitting against the side wall (134) of the cavity (128) and a cylindrical portion (140) and a frustoconical portion (142) therebetween, and positioning the forming die (136) to enter the die cavity (128) so that the cylindrical portion (140) enters the opening (132) of the seating surface (130); disposing a preformed cylindrical collar (10) in the die cavity (128); and compressing the preformed collar (10) between the shoulder (138) and the seating surface (130) as the forming die (136) enters the die cavity (128) to cold form the first portion (120) against the frustoconical surface (142) and to cold form the notch portion (122) within the space between the cylindrical portion (140) and the seating surface (130). to form the collar (10').

2. A method as set forth in claim 1 further characterized by compressing the preformed collar (10) while restraining the outer surface (118) from radial movement to move the inner surface radially inward in forming the first portion (120) and the notch portion (122) of the collar (10') against the frustoconical surface (142) and to cold form the notch portion (122) within the space between the cylindrical portion (140) and the seating surface (130) to form the collars (10').

* * * * *